United States Patent [19]

Parrock

[11] Patent Number: 4,516,417

[45] Date of Patent: May 14, 1985

[54] CHANGEABLE KEYLOCK HAVING TUMBLERS WITH SHIFTABLE PIVOT SEATS

[75] Inventor: Joseph J. Parrock, Milford, Ohio

[73] Assignee: American Standard Inc., New York, N.Y.

[21] Appl. No.: 449,378

[22] Filed: Dec. 13, 1982

[51] Int. Cl.[3] ..... E05B 25/00

[52] U.S. Cl. ..... 70/384; 70/377

[58] Field of Search ..... 70/382-384, 70/377, 355

[56] References Cited

U.S. PATENT DOCUMENTS

| | | |
|---|---|---|
| 1,049,648 | 1/1913 | Benham . |
| 1,136,067 | 4/1915 | Watson . |
| 1,148,282 | 7/1915 | Benham . |
| 1,268,900 | 6/1918 | Watson . |
| 1,447,865 | 3/1923 | Kihm . |
| 1,534,495 | 4/1925 | Benham . |
| 1,546,001 | 7/1925 | Benham et al. . |
| 1,573,741 | 2/1926 | Parent . |
| 3,665,741 | 5/1972 | Holst . |
| 3,727,439 | 4/1973 | Parrock . |
| 3,978,700 | 9/1976 | Glass . |
| 4,072,032 | 2/1978 | Phillips . |

FOREIGN PATENT DOCUMENTS

| | | | |
|---|---|---|---|
| 115324 | 12/1968 | Norway | 70/384 |

*Primary Examiner*—Gary L. Smith
*Assistant Examiner*—Russell W. Illich
*Attorney, Agent, or Firm*—Wood, Herron & Evans

[57] ABSTRACT

Disclosed is a key changeable lock of the lever tumbler type wherein at least one tumbler has a series of seats which are alternatively engageable with a fixed pivot. A biasing spring urges the tumbler seats toward the pivot and tends to hold a particular seat against the pivot to define the axis of tumbler rotation. To change the combination, the tumbler is positively shifted along the series of seats by turning a key which bears against the tumbler and overcomes the biasing force of the spring, displacing one seat from the pivot and shifting the tumbler until another seat engages the pivot.

17 Claims, 7 Drawing Figures

CHANGEABLE KEYLOCK HAVING TUMBLERS WITH SHIFTABLE PIVOT SEATS

FIELD OF THE INVENTION

This invention relates to improvements in key changeable locks of the lever tumbler type.

BACKGROUND

Locks of the general type to which this invention is directed have a series of tumblers which are in the form of pivoted levers. Each tumbler is mounted for angular movement about an axle or other pivot, and pivots when the tumbler is engaged by a lift of a key as the key is turned. To withdraw the bolt and open the lock, each tumbler must be turned by the key about its pivot through a precise angle such that a gate or notch formed in the tumbler is aligned with a so-called "racking bar" on the bolt, or with a "comb" that moves with the bolt. If any tumbler gate is disaligned with the racking bar or comb, that tumbler blocks withdrawal of the bolt; if all the gates are aligned, they receive the racking bar or comb and permit the bolt to be withdrawn. Thus the "shape" of the key or, more precisely, the heights of the respective lifts of the key, determine the positions to which the tumblers are turned by rotation of the key; conversely, the positions at which the tumbler gates are aligned determine the shape of the key. In order to use a different key, it is necessary to change the amount of rotary movement which brings one or more of the tumblers into position of alignment.

THE PRIOR ART

In order to more easily "set" a key lock so that it will respond to a particular key, or to change it so that it will respond to a key different than that to which it was originally set, so-called "key changeable" locks have been provided and are known in the art. Usually a special "change" key is inserted into the lock (when the lock has already been properly opened) to alter the tumbler positions at which the gates are aligned. Various types of key setting and/or changing systems are known. In one key change system, the position of the gate relative to the rest of the tumbler is changed, in order to change the key. A system of that type is shown in the Glass, U.S. Pat. No. 3,978,700. In another type of change mechanism the "shape" of the bolt comb is changed when the change key is operated. Locks of that type are shown in Benham U.S. Pat. No. 1,534,495 and in Parent U.S. Pat. No. 1,573,741 (FIG. 14). In yet another type of setting mechanism the position of that part of the tumbler which is engaged by the operating key is changed to set the key; see my prior U.S. Pat. No. 3,727,439, titled "Modular Key Lock Having Lever Tumblers With Bendable Portions."

In still another type of key change system, the position of the tumbler pivot, about which the key turns the tumblers, is changed. It is with this latter type of system that this invention is particularly concerned. Several key changeable lever tumbler locks having changeable pivot points are known. The concept first appears in a 1913 patent to Benham, U.S. Pat. No. 1,049,648, which teaches a safe deposit box lock in which each tumbler (designated at G in that patent) is provided with a series of pivot holes g at one end. The position of tumbler alignment is changed by physically removing the pivot pin f from the lock case and replacing it in a different one of the tumbler pivot holes g. That concept thus requires that the pivot pin be removed not only from the tumbler but from the lock case itself in order to change the key. A later Benham patent, U.S. Pat. No. 1,546,001, also shows a lock wherein a pivot pin 22 can be removed axially from the lock case and replaced in a different seat 23 in the tumbler, to change the key combination.

Benham U.S. Pat. No. 1,148,282 shows a tumbler 5 having a series of open notches along an edge opposite from the gate. The notches provide different seats for a bladelike catch 18, which acts as a pivot. The pivot is mounted on a swingable arm 9 which is change key operated to release it from a particular notch, so that the key combination can be changed. Thus in that patent the pivot is removed in the plane of the tumbler, rather than in the axial direction, in order to release the tumbler and change the combination. Two patents to Watson, U.S. Pat. Nos. 1,136,067 and 1,268,900 show other variations of the swing-away pivot arrangement.

Kihm U.S. Pat. No. 1,447,865 shows a tumbler 30 having an edgewise series of teeth 32 presenting notches between them, in which a movable pivot tooth 45 can selectively be seated. In that patent the pivot is carried on a laterally shiftable slide plate 40. Lineal lateral movement of the slide plate removes the pivot from the notches to change the combination.

Holst U.S. Pat. No. 3,665,741 shows a lock wherein a lever tumbler pivot is in the form of a blade or knife 11 and is mounted on a swingable arm 13. The blade 11 can be selectively engaged in and released from any of a series of pivots in the form of notches 12 on the tumblers. The pivot is disengaged from the tumbler pivot notches by lateral shifting.

Most recently, Phillips U.S. Pat. No. 4,072,032 teaches a lock having a tumbler pivot 100 which is rotatable about its axis to release the tumblers. Each tumbler 110, 120, has a series of pivot seats 114, 124 formed in an internal aperture; these are selectively engaged by the pivot 100. To change the combination the pivot 100 is first turned about its axis, being journaled by the case for such rotation, to disengage its rib 106 from the particular tumbler seat 114 or 124. The tumbler is moved laterally relative to the pivot by a spring 115 or 125, which when the pivot has been turned urges the tumbler toward a neutral position from which it can be key-shifted to another position relative to the pivot. The pivot 100 is then rotated back so that its rib 106 interfits with the new tumbler pivot seat, and holds the tumbler against further shifting. The Phillips patent thus requires rotational movement of the pivot in order to release the tumblers before they can be shifted, and depends on spring means to move the tumblers once they have been released.

BRIEF DESCRIPTION OF THE INVENTION

Unlike the prior art locks which require movement of the pivot relative to the lock case to change the pivot axis, in the lock of this invention the pivot is fixed in the case and the tumblers are shifted relative to the fixed pivot to change the combination. Each tumbler is moved positively by a change key, in opposition to a spring force that tends to hold a particular seat in rotational engagement with the pivot, to disengage one seat and engage a different seat with the pivot. The seats are in the form of a series of notches in the tumbler. The change key is brought into direct or positive engagement with the tumbler and, overcoming the force of the biasing spring, the key shifts the tumbler to a new seat position. Thus, in the lock of this invention the pivot remains fixed and only the tumblers are moved; and they are moved positively, by direct engagement with a key, rather than by spring force.

The invention can best be further described by reference to the accompanying drawings in which, FIG. 1 is a fragmentary perspective view of a typical environment in which the lock of this invention may be used, comprising a series of safe deposit boxes;

FIG. 3 is an elevation of an individual customer tumbler in accordance with the preferred embodiment of the invention;

DETAILED DESCRIPTION

Although the improvement of this invention can be used in many types of key changeable locks, its widest utility may be in locks for safe deposit boxes. For that reason, the preferred embodiment of the invention is primarily described hereinafter in relation a lock for that type of use.

Safe deposit boxes commonly use two keys for operation. One key, called the guard key, is retained by the bank or other institution at which the safe deposit box is located. That key must be used in conjunction with a separate customer key which is retained by the customer. The bank cannot open the box without use of the customer's key; and the customer cannot open other boxes. The guard and customer keys act on guard and customer tumblers respectively in each lock. Either the guard tumblers or the customer tumblers, or both, may be key changeable. However, since the customer key can be expected to be changed far more frequently than the guard key, the mechanism for changing the guard key may be different than that for setting or changing the customer key. In the preferred embodiment illustrated, the mechanisms are different.

FIGS. 1–6 of the drawings illustrate a safe deposit box lock having a set of guard tumblers and a set of customer tumblers, wherein the customer tumblers are in accordance with this invention, but wherein the guard tumblers are key changeable by bending as described in my previously identified U.S. Pat. No. 3,727,439, to which reference may be had. It should be understood however, that the change mechanism of the invention can also or alternatively be used with guard tumblers, and one form of guard tumbler for that purpose is described hereinafter.

Figure 1:
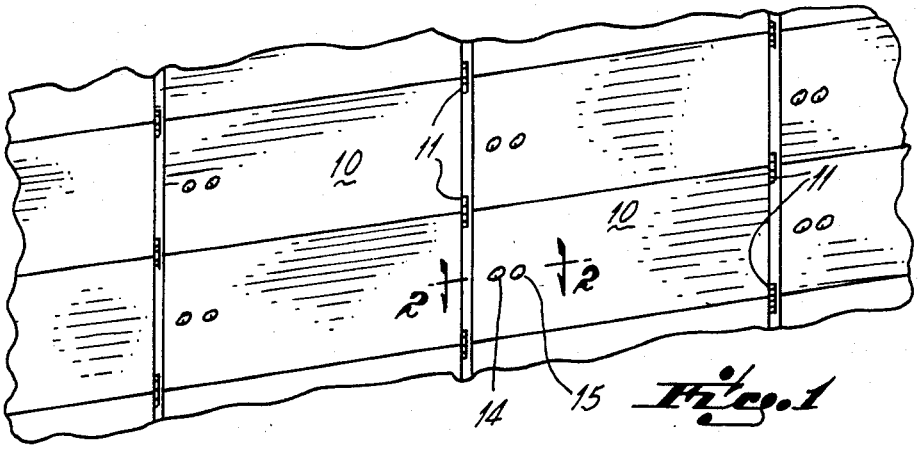

Referring to the drawings in detail, FIG. 1 illustrates a safe deposit box installation which includes a plurality of lockable doors, each designated at 10. Each door is hinged at one side, as at 11. The lock side of each door 10 (the left side, as viewed in FIG. 1) has two key receiving noses 14 and 15. These receive the customer and guard keys respectively for operating the lock, designated at 18, which is mounted on the inside of the door. The guard key will operate the guard tumblers of all of the locks, but each lock requires its own individualized customer key to operate its customer tumblers. Both the customer and guard tumblers must be aligned before the bolt can be withdrawn, as will appear.

As shown in FIGS. 2 and 4–6, the lock 18 is fastened by machine screws 19 to the inside surface of the box door 10, and is contained within a two part housing which includes a case 20 and a lid or cover plate 21. The lid 21 is disposed against the inside surface of door 10, with the two noses 14 and 15 projecting from the cover into apertures formed in the door 10, substantially to the surface of the lock door. Noses 14 and 15 receive customer and guard keys 34 and 35 respectively, see FIGS. 4 and 5.

Figure 5:
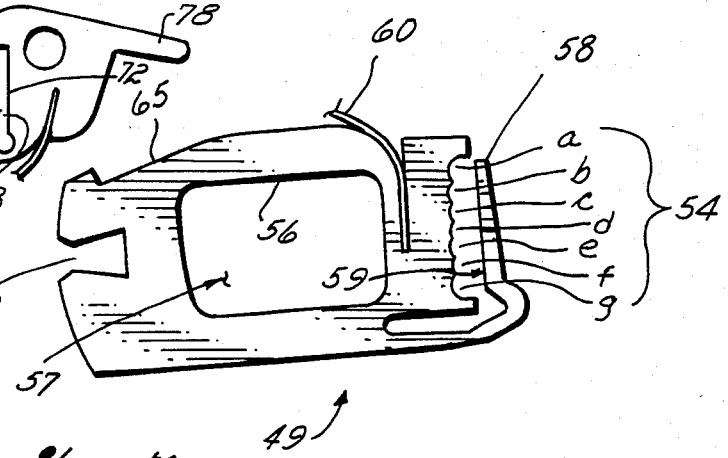
FIG. 5 is a vertical section similar to FIG. 4 but shows the lock elements after the tumbler has been set in a neutral condition by use of the change key, wherein the pivot post is engaged in the first seat of the series.
Figure 4:
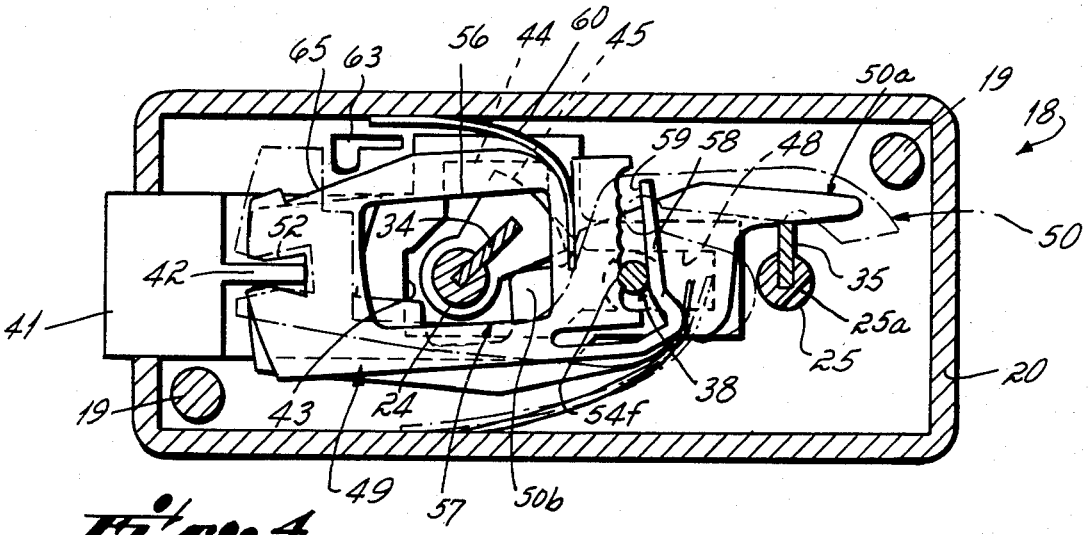
FIG. 4 is a vertical section taken on line 4—4 of FIG. 2, showing the lock in unlocked condition with the pivot post engaged in the sixth seat of a series of seven seats.
Figure 5:
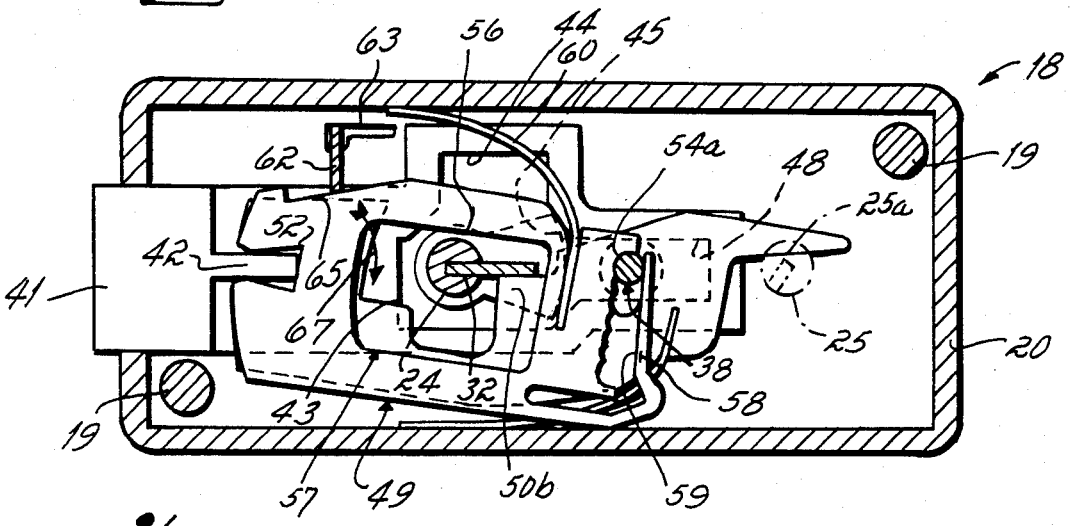
Figure 6:
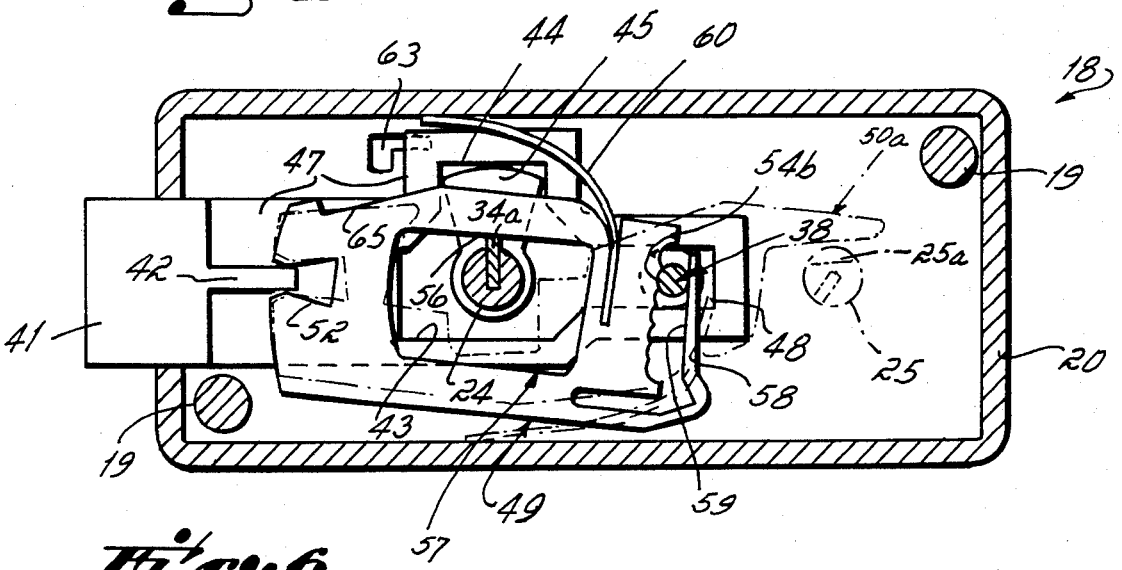
FIG. 6 is a vertical section similar to FIGS. 4 and 5 but shows the lock reset to a new combination in which the pivot post is engaged in the second pivot seat, the operating key having been turned.

A key post 24 (which receives the customer key) and a key post 25 (which receives the guard key) are rotatably supported at their opposite ends between the noses 14, 15 respectively, and apertures 26, 26 in the bottom of the lock case 20. Each key post 24, 25, has an elongated shank portion 28, a smaller diameter neck 29 which is seated in a case aperture 26, and an enlarged head 30 which is retained by a flange or rim in the respective nose 14, 15. Thus, each key post 24 and 25 is rotatable within its respective journals, but cannot shift axially. As shown in FIGS. 4–6, the key posts 24 and 25 are slotted along their length as at 32, to receive customer key 34 and guard key 35, respectively.

Figure 2:
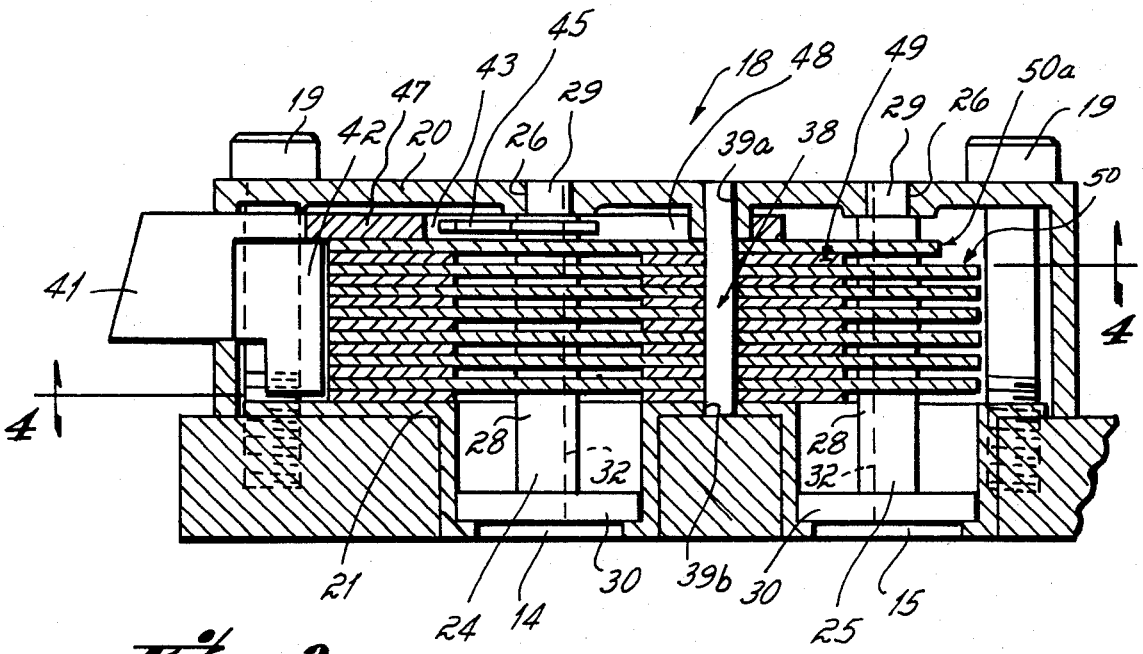
FIG. 2 is a horizontal section taken on line 2—2 of FIG. 1, showing a preferred embodiment of the lock in accordance with the invention.

A tumbler pivot in the form of a post 38 is rigidly mounted between the inner or back surface of the lock case and the lid 21 (see FIG. 2). Post 38 may be a roll pin which is secured in apertures **39*a* and 39*b* in the case and cover respectively, to hold the case and cover in closed relation before the lock is secured to door 10 by bolts 19. In the embodiment illustrated, this post 38** serves as the pivot for both of the two sets of tumblers.

Lock case 20 has an endwise opening through which a bolt 41 extends. The bolt includes a so-called bolt pin or racking bar 42, and is movable between an extended (or locked) position shown in FIGS. 2 and 6, and a retracted (or open) position shown in FIGS. 4 and 5. The bolt has an extension 47 which resides adjacent the inner wall of case 20, and which contains a slot 43. Post 38 extends through an elongated portion 48 of slot 43 and supports and guides the bolt for sliding between the retracted and extended positions. Bolt slot 43 also includes a portion 44 which is engaged by and cooperates with a bolt thrower in the form of a key bit or foot 45 (see FIGS. 4–6) mounted at the inner end of the rotatable customer key post 24. The shape of bolt slot 43, in contact with key bit 45, limits the extension and retraction of the bolt.

The lock includes a set of customer tumblers, each designated by 49, which are operated by customer key 34, and a set of guard tumblers 50 (phantom line in FIG. 4) which are operated by guard key 35. As already noted, in the embodiment illustrated in FIGS. 1–6 the seat shifting mechanism of the invention is used with the customer tumblers but not with the guard tumblers. In that particular embodiment there are seven tumblers of each type, which are arranged alternately with one another within the case (see FIG. 2), however neither the number of tumblers nor their arrangement with one another is critical. All of the tumblers 49 and 50 are levers which pivot about post 38.

As shown in FIG. 2, the customer and guard tumblers are preferably interleaved with one another on post 38; a customer tumbler 49 is adjacent lid 21, next a guard tumbler 50, then a second customer tumbler, etc. For further description of a suitable type of guard tumbler 50, reference may be had to my previously identified U.S. Pat. No. 3,727,439. It is preferred that that guard tumbler 50*a* which is adjacent bolt extension 47, be specially shaped as shown in FIGS. 4–6, for purposes to be described.

Only a single customer tumbler 49 and a single guard tumbler 50 (apart from the special guard tumbler 50*a*) are shown in FIGS. 4–6, in order to simplify those drawings, but it will be apparent that the other tumblers of the respective sets can be similar in outline form except that they may vary from tumbler to tumbler in respect to gate position, and hence position of alignment.

The customer tumbler 49 is preferably in the form of a thin, flat member, one of which is shown in FIG. 3. At one end each customer tumbler 49 has a gate 52 which receives the racking bar 42 of the bolt when the bolt is withdrawn (see FIGS. 4 and 5). Each tumbler 49 is pivoted about fixed post 38; the post is seatable in any one of a series of seats or notches designated by 54*a–g*, in FIGS. 4–6. The seats are arcuate or semicircular, and are preferably formed next to one another with their centers lying on a straight line. Seven seats are shown in this particular embodiment, for actuation by seven different key lift heights. By shifting the tumbler so that its seats are moved in the direction tangential to the post 38, different seats 54*a–g* can be engaged with the post, and hence the angular position of gate alignment can be changed.

Each tumbler has an edgewise surface 56 which is acted upon by a lift of the customer key 34, see FIG. 6. In the embodiment shown this key engaging surface 56 comprises an edge portion of an internal opening or aperture 57 formed in the tumbler, through which the customer key post 24 extends. As shown in FIG. 6, when the customer key 34 is inserted in key slot 32 and turned, the lift of the key is engaged with tumbler surface 56 thereby swinging the tumbler about pivot post 32, and positioning tumbler gate 52 with respect to racking post 42.

Spring means 58 are provided to maintain engagement between the respective tumbler seats 52*a–g* and post 38. This spring means is preferably in the form of a leaf spring, having a substantially flat post-engaging surface 59 which bears against the surface of post 38 opposite from the seats 54. Spring 58 tends to move the tumbler rightward as viewed in FIGS. 4–6, toward post 38, so that the respective seat 54 is pressed against the post to form a journal for tumbler rotation. The tumbler is biased counterclockwise about post 38 by a spring 60. The force of spring 60 is insufficient to overcome the force of spring 58 which, like a detent spring, tends to hold a particular seat against the post. Thus, during opening of the lock by the customer key, a particular one of the seats 54*a–g* remains constantly engaged with post 38, that is, the tumbler seat does not change. The biasing force of spring 60 urges key-engaging surface 56 toward key post 24, to maintain engagement between the tumbler and the key as the key is turned.

The combination of the lock is changed by shifting the seats in a lateral direction, i.e., tangentially to post 38, to engage a different seat with the post. This is done by the use of a change key, shown at 62 in FIG. 5. This change key 62 is inserted through a change key aperture 63 in the bottom face of lock case 20. The lift of change key 62 is engageable with a change key engaging surface 65 of tumbler 49, when the change key is turned clockwise (as viewed in FIG. 5) from its insert position. Bolt extension plate 47 blocks aperture 63 unless the bolt has been fully withdrawn, so that key 62 can be used only if the lock has been opened.

As a safety precaution, it is preferred that the combination can be changed only when the customer key has been removed. When this has been done, turning the change key to the position shown in FIG. 5 swings the tumbler 49 clockwise about the pivot formed by engagement of racking pin 42 in tumbler gate 52. This motion is indicated by arrow 67 in FIG. 5. The force exerted by the turning of change key 62 overcomes that of spring 58, causing the latter to yield and moving the tumbler seats downwardly so that the post progressively moves from seat 57*f* in which it was earlier engaged, past seats 54*e, d, c,* and *b,* to seat 54*a*.

The provision of the special guard tumbler 50*a*, which lies next to bolt extension 47, is preferred, in order to provide a desirable safety feature. This tumbler prevents the rotation of customer key 34 to the neutral position of FIG. 5 unless change key 62 is first operated; and it prevents the customer key from being withdrawn unless the bolt has been withdrawn. Specifically, a corner 50*b* of a tumbler 50*a* arrests rotation of key 34 from open position (FIG. 4) to neutral position (FIG. 5) unless the tumbler has been swung out of the way by operation of guard key 35. The guard key engages and lifts the tail or extension of tumbler 50*a*, pivoting the tumbler counterclockwise around post 38. Thereafter operation of change key 62 turns guard tumbler 50 to the neutral position, and customer key 34 can be removed, so that a different customer key can be inserted to change the combination.

The customer key is changed in two steps: first, as described above, by operation of the change key which moves the tumbler to a starting or neutral position, in which post 38 is seated in seat 54*a*, then by insertion of the new customer key. This moves the tumbler from neutral position (FIG. 5) to the new position in which another seat 54*b–g* is engaged with post 38. This is done by turning change key 62 to disengage it from the tumblers, removing it from the lock, then inserting the new customer key 34 and turning it counterclockwise to the position shown in FIG. 6. As this is done, the customer key lift is brought into driving engagement with key engaging surface 56 and raises the tumbler relative to post 38, shifting the seat past the post. In FIG. 6 the post is shown is engaged with a new seat 54*b*.

It is contemplated that a safe deposit box lock of this type may be supplied by the manufacturer in the neutral position, i.e., with post 38 engaged in the "neutral" (uppermost) seat 54*a*. To activate the customer side of the lock when the box is rented, the operational sequence in the preferred form of lock, can be as follows:

(a) The guard key is inserted and rotated to set up (align) the guard tumbler.

(b) A neutral customer key is inserted and rotated. This puts the lock in the condition depicted in FIG. 4, and withdraws the bolt, but does not move the pivot.

(c) The guard key is then turned back to the insert position and removed. The tumbler post 25 is then rotated, as by the tip of the key, until flat 25*a* of post 25 is aligned with the tail of tumbler 50*a*. This rotates the tumbler further, to permit the tip of the neutral key to clear tumbler 50*a* and be removed.

(d) The neutral customer key is rotated clockwise to the position shown in FIG. 5, and is removed.

(e) The change key is inserted in the customer change slot and rotated counterclockwise to the position shown in FIG. 5. The key is held in this position, to hold the tumbler 50*a* in the FIG. 5 position.

(f) The desired customer key is inserted in the key post 24.

(g) The change key is turned back and removed from its slot.

(h) The customer key is rotated counterclockwise past the FIG. 6 position, to the fully locked position, and is then removed.

The lock has thereby been set to the desired customer key. The customer key side of the lock can be changed to accept new keys by following the same steps.

Figure 7:
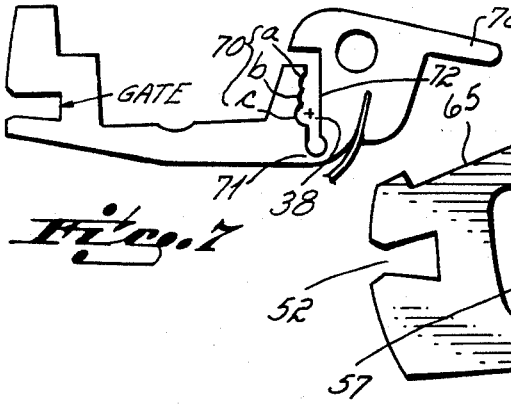
FIG. 7 is an elevation of an individual guard tumbler in accordance with a modified embodiment of the invention.

In the embodiment described the novel tumbler is a customer tumbler in the form of a third class lever in which the pivot 38 is at one end of the lever, the force exerted by customer key 34 is exerted on the lift surface 56 near the middle of the lever, and the load, i.e., the gate 52, is at the far end of the tumbler. This particular arrangement is preferred for use with changeable customer tumblers because of its physical compatibility with existing locks. However, the invention can also be used with other forms of tumblers, for example with a changeable guard tumbler having its pivot between the guard key engaging surface and the gate. FIG. 7 illustrates one form of key changeable guard tumbler in accordance with the invention. This tumbler has a series of three seats 70*a, b* and *c*, which are alternatively engageable with post 38. A narrow elastic neck 71 provides a spring biasing force on tumbler edge 72 that causes it to bear against the post and thereby bias the opposite seat against the pivot. It can be seen that this tumbler is a second class lever, in which the fulcrum (38) is between the point (78) at which the key force is applied, and the load (the gate).

From the foregoing it can be seen that when the key is being changed the tumblers are positively shifted to the neutral position by the rotation of the change key. This is an advantage in comparison to locks such as that shown in U.S. Pat. No. 4,072,032 previously discussed, wherein the tumblers are spring biased to neutral position, and may stick in place, with the result that they are not shifted to neutral position but rather remain at an indeterminate position.

Having described the invention, what is claimed is:

1. In a key changeable lock wherein at least one lever tumbler is turned about a pivot in a lock case by an operating key into a rotational position of alignment to permit a bolt to be withdrawn, the improvement wherein, said pivot is fixedly secured against movement in the lock case, said tumbler presents a series of seats in the form of notches, the notches being alternatively engageable with said pivot, spring means exerting a biasing force from a fixed surface in the lock to said tumbler and tending to move the tumbler toward said pivot to maintain a particular one of said seats in rotational engagement with said pivot, and said tumbler is movable by a change key which bears directly on the tumbler to move it so that said seats are shifted in a direction tangential to said pivot, against the bias of said spring means, thereby to disengage one of said seats from said pivot and engage another seat therewith, the rotational axis of the tumbler thereby being changed so that the rotational position of alignment of the tumbler is also changed.

2. The improvement of claim 1 wherein said series of seats is formed along an edge of said tumbler.

3. The improvement of claim 1 wherein said series of seats comprises a series of arcuate notches adjacent to one another along an edge of said tumbler.

4. The improvement of claim 1 wherein said series of seats lies along a straight line

5. The improvement of claim 4 wherein said spring means comprises a leaf spring affixed to and projecting from the tumbler and bearing on a side of said pivot opposite from said series of seats.

6. The improvement of claim 5 wherein said spring means is integral with said tumbler.

7. The improvement of claim 6 wherein said spring means has a substantially flat bearing surface which lies generally parallel to the series of seats and in unstressed condition is normally spaced from them a distance less than the diameter of said pivot.

8. The improvement of claim 1 wherein said tumbler has a gate on one end, said series of seats is at an opposite end of said tumbler from said gate, and an operating key engages the tumbler between the gate and the series of seats.

9. The improvement of claim 1 wherein said pivot is a round post which is rigidly mounted by the lock case.

10. The improvement of claim 1 wherein said spring means is a detent spring.

11. The improvement of claim 1 wherein a change key is receivable in said case when said bolt is withdrawn and which when operated bears upon the tumbler to shift the tumbler in its plane in a direction generally parallel to said series of seats against the biasing force of said spring means.

12. In a tumbler for a key changeable lock wherein the tumbler is rotatable about a pivot, the improvement wherein, said tumbler presents a series of alternative pivot seats in the form of a series of notches, and said tumbler includes spring means, said spring means being engageable with a fixed surface of the lock to exert a reaction force on the tumbler which biases said tumbler toward said pivot, thereby tending to maintain one of said notches seated against said pivot, said tumbler also presenting a surface engageable in use by a change key, said surface so positioned with respect to said series of notches that when said change key is turned against said surface it moves said tumbler to seat a different notch against said pivot, said spring means being a leaf spring which is sufficiently elastic that said tumbler can be moved relative to the pivot and against the force of said spring means, to engage a different notch against said pivot, without any movement of the pivot, said leaf spring having a surface facing said series of notches and forming therewith a slot.

13. The tumbler of claim 12 wherein said series of seats is formed at an end of said tumbler.

14. The tumbler of claim 12 wherein said series of seats comprises a series of arcuate notches adjacent to one another.

15. The tumbler of claim 12 wherein said spring means lies in the plane of the tumbler.

16. The tumbler of claim 12 wherein said spring means is secured to the tumbler.

17. The tumbler of claim 12 wherein said spring means bears on said pivot as the fixed surface.

* * * * *